US009766038B2

(12) United States Patent
Toole

(10) Patent No.: US 9,766,038 B2
(45) Date of Patent: Sep. 19, 2017

(54) LASER AIMING AND ILLUMINATION DEVICE FOR A WEAPONS PLATFORM

(71) Applicant: CQB Optics, LLC, Oregon City, OR (US)

(72) Inventor: Ronald L. Toole, Oregon City, OR (US)

(73) Assignee: CQB Optics, LLC, Oregon City, OR (US)

( * ) Notice: Subject to any disclaimer, the term of this patent is extended or adjusted under 35 U.S.C. 154(b) by 0 days.

(21) Appl. No.: 14/941,420

(22) Filed: Nov. 13, 2015

(65) Prior Publication Data

US 2016/0209169 A1 Jul. 21, 2016

Related U.S. Application Data

(60) Provisional application No. 62/105,161, filed on Jan. 19, 2015, provisional application No. 62/105,931, filed on Jan. 21, 2015.

(51) Int. Cl.

| | |
|---|---|
| ***F41G 1/35*** | (2006.01) |
| ***F41G 11/00*** | (2006.01) |
| ***F41G 1/36*** | (2006.01) |
| ***F41C 23/22*** | (2006.01) |
| ***F41C 27/00*** | (2006.01) |

(52) U.S. Cl.

CPC ..... *F41G 1/35* (2013.01); *F41C 23/22* (2013.01); *F41C 27/00* (2013.01); *F41G 1/36* (2013.01)

(58) Field of Classification Search

CPC ..... F41G 1/32; F41G 1/34; F41G 1/35; F41G 1/36; F41G 1/345

USPC ..... 42/114, 123, 117, 131, 132, 146

See application file for complete search history.

(56) References Cited

U.S. PATENT DOCUMENTS 5,064,988 A * 11/1991 E—nama ..... F41G 1/35 219/121.6
5,068,969 A * 12/1991 Siebert ..... F41A 17/22 362/110
5,176,235 A 1/1993 Toole
5,481,819 A * 1/1996 Teetzel ..... F41A 9/62 42/117
5,584,137 A * 12/1996 Teetzel ..... F41A 9/62 362/114
5,822,905 A * 10/1998 Teetzel ..... F41C 23/16 362/114

(Continued)

FOREIGN PATENT DOCUMENTS

EP 2722632 A2 4/2014

OTHER PUBLICATIONS

International Search Report and Written Opinion for PCT Application No. PCT/US2015/060729, dated Apr. 20, 2016, 13 pages.

*Primary Examiner* — Derrick Morgan
(74) *Attorney, Agent, or Firm* — Marger Johnson

(57) ABSTRACT

A laser aiming and illumination device comprising an illumination module, an illumination mode selector, a power module, an activation switch and a connection module. The illumination module including at least one of an illumination source and a laser source configured to be activated in a selected operating by actuation of the activation switch. The illumination mode selector configured to select said operating mode. The connection module releasably electrically connecting the power module and the illumination module.

20 Claims, 12 Drawing Sheets

(56) References Cited

U.S. PATENT DOCUMENTS 6,163,131 A * 12/2000 Gartstein ..... H02J 7/025 320/118
6,622,416 B2 * 9/2003 Kim ..... F41G 1/35 362/110
6,785,997 B2 * 9/2004 Oz ..... F41G 1/35 42/146
7,627,975 B1 * 12/2009 Hines ..... F41C 23/16 42/84
7,827,726 B2 * 11/2010 Stokes ..... F41C 23/16 362/111
7,866,083 B2 * 1/2011 Teetzel ..... F41G 1/35 342/45
8,093,992 B2 * 1/2012 Jancic ..... F41G 1/35 340/12.5
8,220,946 B1 * 7/2012 Teetzel ..... F41C 27/00 362/110
8,225,542 B2 * 7/2012 Houde-Walter ..... F41A 35/00 42/72
8,316,574 B1 * 11/2012 Swan ..... F41C 23/16 42/146
8,402,683 B2 * 3/2013 Cabahug ..... F41C 23/04 42/71.01
8,516,731 B2 * 8/2013 Cabahug ..... F41C 23/22 42/124
8,607,492 B2 * 12/2013 Hartley ..... F41C 23/16 42/72
9,062,933 B1 * 6/2015 Allen ..... F41G 1/35
9,147,875 B1 * 9/2015 Coakley ..... H01M 2/202
9,200,867 B1 * 12/2015 Swan ..... F41C 23/16
9,285,185 B2 * 3/2016 Cabahug ..... F41C 23/22
2008/0134562 A1 * 6/2008 Teetzel ..... F41G 11/003 42/146
2010/0091485 A1 * 4/2010 Matthews ..... F21L 4/027 362/234
2010/0192443 A1 * 8/2010 Cabahug ..... F41C 23/16 42/71.02
2010/0192444 A1 * 8/2010 Cabahug ..... F41G 11/003 42/71.02
2010/0192448 A1 * 8/2010 Darian ..... F41C 23/22 42/84
2010/0218410 A1 * 9/2010 Cabahug ..... F41C 27/00 42/71.01
2010/0229448 A1 * 9/2010 Houde-Walter ..... F41C 23/16 42/72
2011/0047850 A1 * 3/2011 Rievley ..... F41C 23/16 42/72
2011/0058362 A1 * 3/2011 Sun ..... F41G 1/35 362/187
2011/0173865 A1 * 7/2011 Compton ..... F41G 11/003 42/84
2011/0255270 A1 * 10/2011 Gross ..... F41C 23/16 362/110
2011/0283585 A1 * 11/2011 Cabahug ..... F41C 23/22 42/73
2012/0131840 A1 5/2012 Toole
2012/0268920 A1 * 10/2012 Matthews ..... F41G 11/003 362/110
2013/0061509 A1 * 3/2013 Allen ..... F41A 33/02 42/115
2013/0143075 A1 * 6/2013 Yi ..... H01M 2/1055 429/7
2013/0185982 A1 * 7/2013 Hilbourne ..... F41G 1/35 42/117
2013/0194769 A1 * 8/2013 Belack ..... F41G 11/003 361/807
2013/0235609 A1 * 9/2013 Nemeyer ..... F21V 13/02 362/553
2014/0007485 A1 * 1/2014 Castejon, Sr. ..... F41G 1/35 42/117
2014/0059911 A1 * 3/2014 Oh ..... F41C 23/22 42/16
2014/0092588 A1 * 4/2014 Toman ..... F41G 11/003 362/110
2014/0130392 A1 * 5/2014 Oh ..... F41G 11/003 42/84
2014/0245650 A1 * 9/2014 Abst ..... F41C 27/00 42/84
2014/0317988 A1 * 10/2014 Battis ..... F41H 13/0087 42/114
2015/0113851 A1 * 4/2015 Bensayan ..... F41A 17/063 42/117
2015/0247703 A1 * 9/2015 Teetzel ..... F41G 3/065 356/5.01
2015/0377470 A1 * 12/2015 Tuller ..... F41H 13/0087 362/373

* cited by examiner

LASER AIMING AND ILLUMINATION DEVICE FOR A WEAPONS PLATFORM

BACKGROUND

The AR-15 style weapons platform is one of the most popular rifles on the market today. The standardized design and modular nature of the weapon allows users and manufacturers to readily and easily customize the weapon while staying within a standard framework. Due to the standardized nature and modularity of the AR-15 platform, a thriving secondary accessories market exists since the accessories can be installed on AR-15's across multiple manufacturers. User can choose any number of accessories to outfit to their AR-15, including lights, lasers and scopes.

One of the most popular laser, light or laser/light combination accessories is a self-contained carrier that includes the illumination/laser element(s) and can be affixed to a standard accessory rail of the weapon. These self-contained units contain the power source for the illumination/laser elements and the various associated switch and electrical circuitry to control functioning of the illumination/laser elements. Typically, the self-contained unit is rather bulky or large and often mounted far forward on the weapon so as to not interfere with the operators handling of the weapon. To select an operating mode of the illumination/laser element (s), the operator is often required to manipulate the weapon into an un-ready position to access the device to select a desired operating mode or to activate the device. Once the operator has selected the desired operating mode or activated the device, the operator can then reshoulder, or manipulate, the weapon into a ready position. Having the weapon in an un-ready position makes the operator vulnerable and unable to respond quickly and/or accurately to threats that may arise. Additionally the activation of the illumination/laser element(s) prior to hostile engagement can reveal the operator's location, negating any stealth or surprise the operator may have had.

There exists a need for a device that integrates a laser and/or light source into a singular package that can be activated single-handedly while allowing the user to maintain the weapon in a ready position or accurately direct the weapon from an unready position.

DETAILED DESCRIPTION

Figure 1:
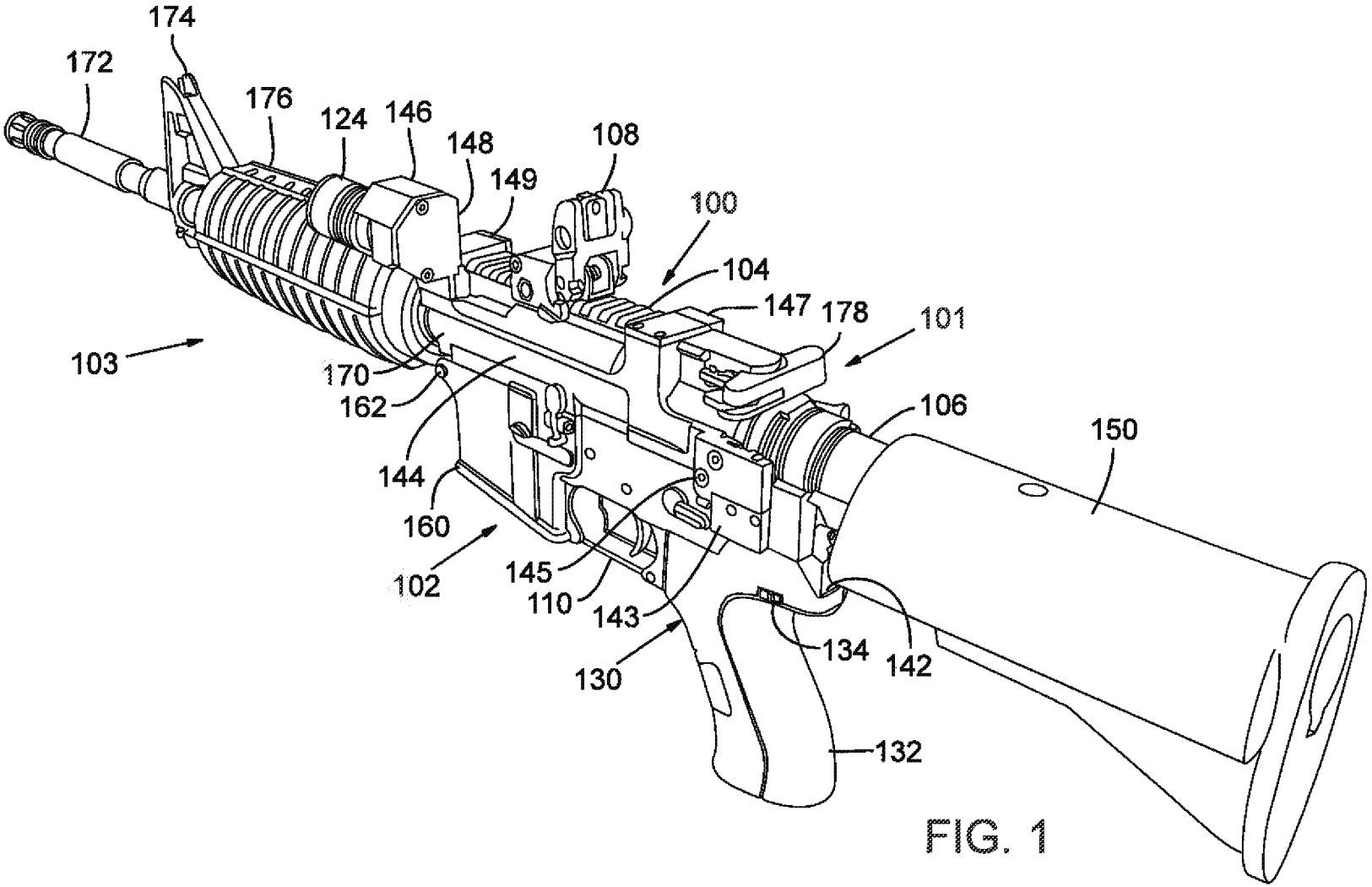
FIG. 1 is a perspective view, down the length of the weapon, of the laser aiming and illumination device mounted to an AR-15 type weapons platform.

FIG. 1 is a perspective view of the laser aiming and illumination device 100 mounted to an AR-15 style weapons platform 101. The device 100 includes an illumination source 124, a laser source 126 (FIG. 6), an activation switch 130, an illumination source operating mode selector 134, a laser source operating mode selector 136 (FIG. 3), batteries 140 (FIG. 7), buffer tube connector 141 (FIG. 4), grip housing 142, lower connector 143, connection module 144, upper connector 145, retention elements 147 and 149, illumination module 146, and illumination housing access 148.

The AR-15 weapons platform 101 is composed of two portions, a lower 102 and an upper 103. The lower portion 102 comprises the lower receiver 160, grip 132, buffer tube 106 and buttstock 150. The upper portion 103 comprises the upper receiver 170, barrel 172, front sight 174, handguard 176, rear sight 108, accessory rail 104 and the charging handle 178. The weapon exists as two halves that are held together by a pivot pin 162 and locked together by a takedown pin 164.

Figure 5A:
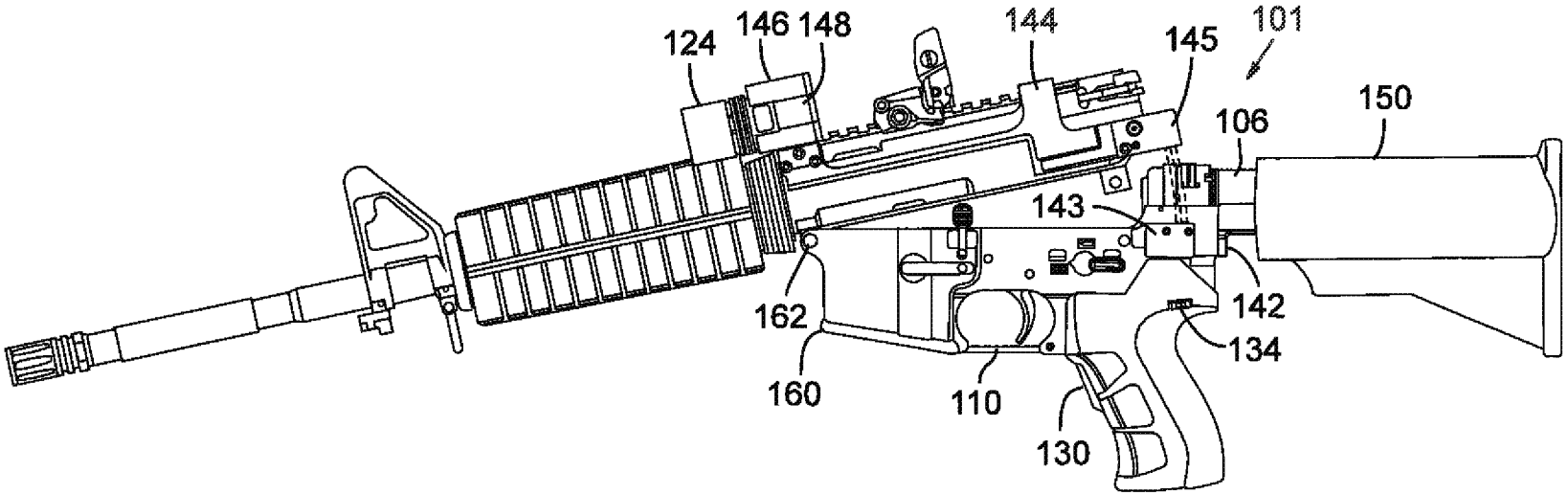
FIG. 5A is a left side view of the device and weapon of FIG. 1, showing the weapon in an open configuration.
Figure 5B:
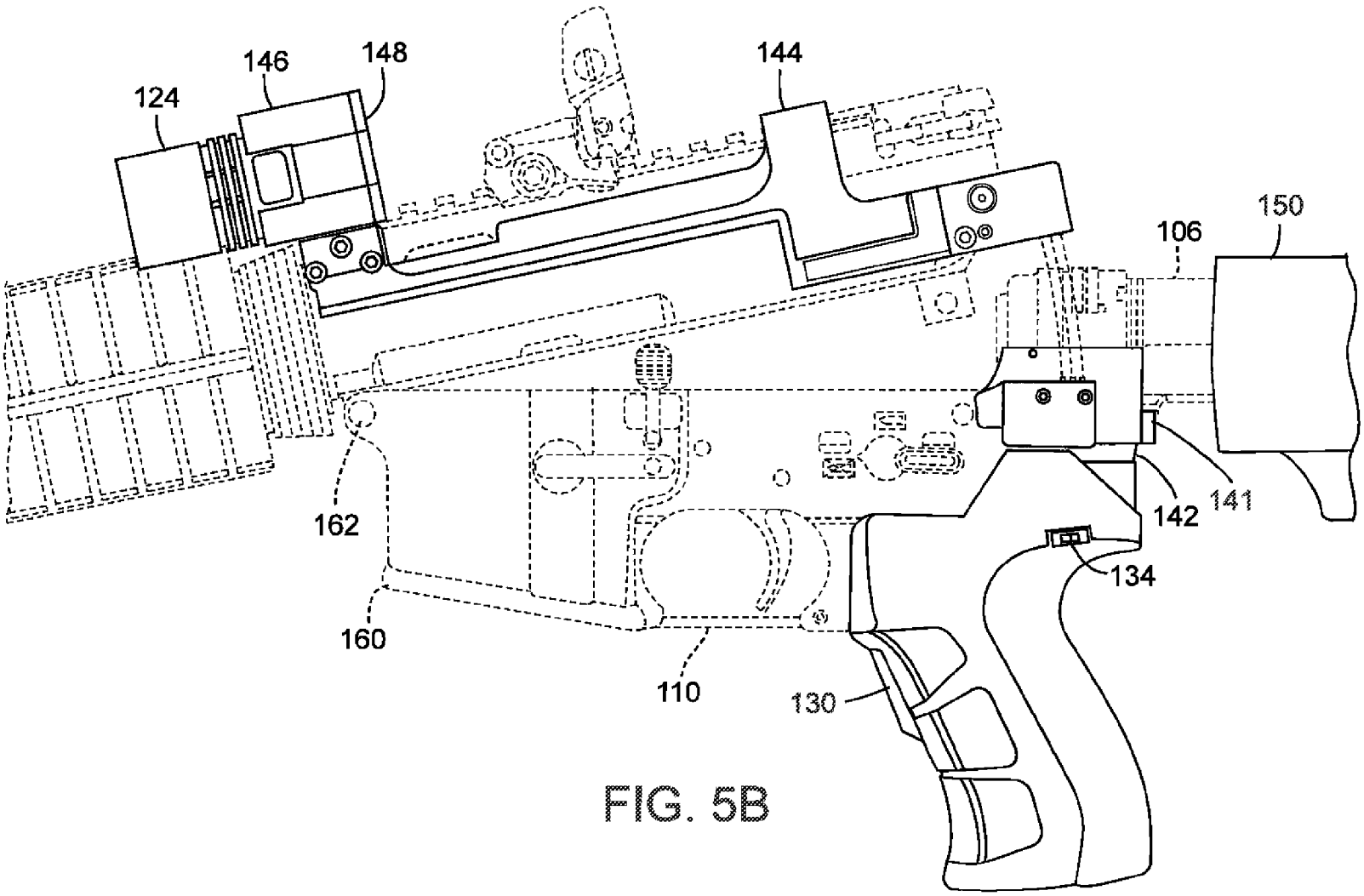
FIG. 5B is a close-up view of FIG. 5A, with the weapon shown in dashed lines.

Takedown of the weapons platform 101 for cleaning or maintenance is accomplished by separating the lower 102 and upper 103 portions. This is done by first displacing the takedown pin 164 and rotating the upper and lower portions 102 and 103 about the pivot pin 162, effectively "breaking open" the weapon 101, as shown in FIGS. 5A and 5B. With the weapon in this state, a user or other person can access the internal components of the weapon 101 for modification, replacement, and/or maintenance. This simple and quick method of takedown was developed for the AR-15 platform to allow users to quickly and easily access the internals of the weapon 101 for maintenance and repair without the need for specialized tools. The laser aiming and illumination device 100 allows for this requisite "break open" ability to occur with the laser aiming and illumination device 100 installed on the weapon 101.

Figure 4:
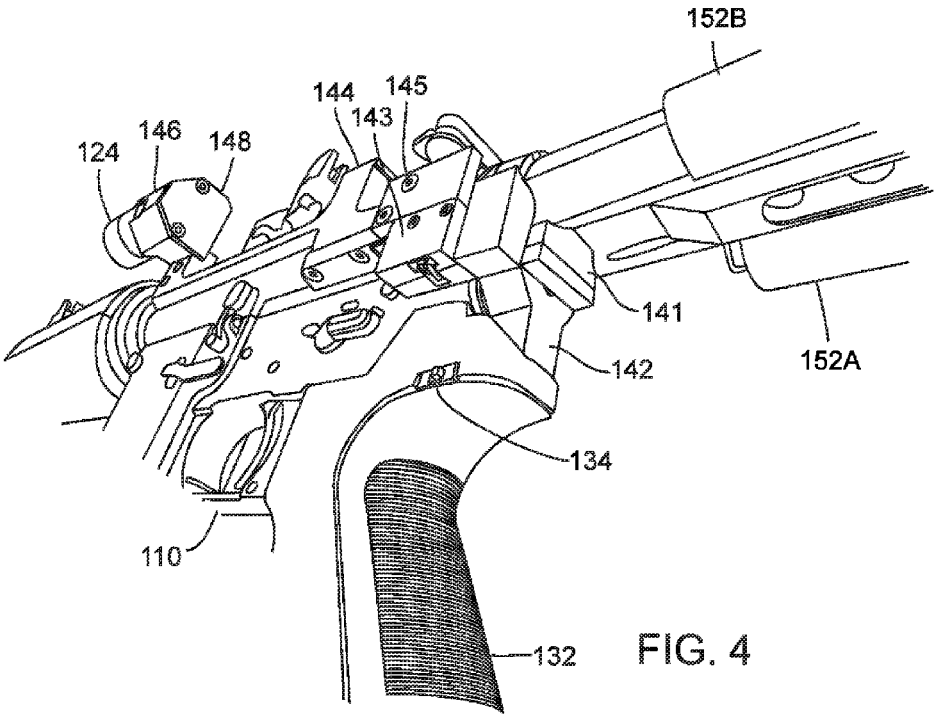
FIG. 4 is a perspective view of the device components mounted about the grip and buffer tube of the weapon of FIG. 1.

A standard buffer tube of a weapons platform 101 can be replaced or modified to the buffer tube 106 of the laser aiming and illumination device 100. To install the device buffer tube 106, the existing, standard buffer tube of the weapon is replaced with the new buffer tube 106. Alternatively, the existing, standard buffer tube can be modified to the buffer tube 106. In this embodiment, the buffer tube 106 includes the power source for the device 100. The power source is electrically connected to a buffer tube connector 141 disposed on the lower surface of the buffer tube 106 (see FIGS. 4 and 5B). Due to the standardized and modular nature of the AR-15 platform, the buffer tube 106 attaches to the weapon 101 in a specific orientation. The buffer tube 106 of the device 100 is affixed to the weapon in the same manner as a standard AR-15 buffer tube which causes the buffer tube 106 to be installed in the weapon 101 in the specific orientation that aligns the buffer tube connector 141 in the proper positioning as shown in FIG. 4.

The majority of the device 100 is mounted to an accessory rail 104 attached to the upper 103 of the weapon 101. A portion of the device is integrated with the grip 132 and another portion is integrated with the buffer tube 106 of the lower 102 of the weapon 101. In the example shown in FIG. 1, the accessory rail is a Picatinny type rail that is commonly used throughout the industry as an accessory rail. The device 100 can be constructed or modified to fit other designs of accessory rails.

The laser aiming and illumination device 100 can also be adapted to fit a variety of different weapons platforms, such as other rifle platforms, like the AK-47, shotguns, etc.

The design of the device 100 enables a person, such as a user, manufacturer, or technician, to mount the device to the weapon 101 easily, without permanently modifying the weapon 101. This ensures that someone can return the weapon 101 to an original, unaltered state by simply removing the components of the device 100 and replacing the original components of the weapon 101.

Figure 7:
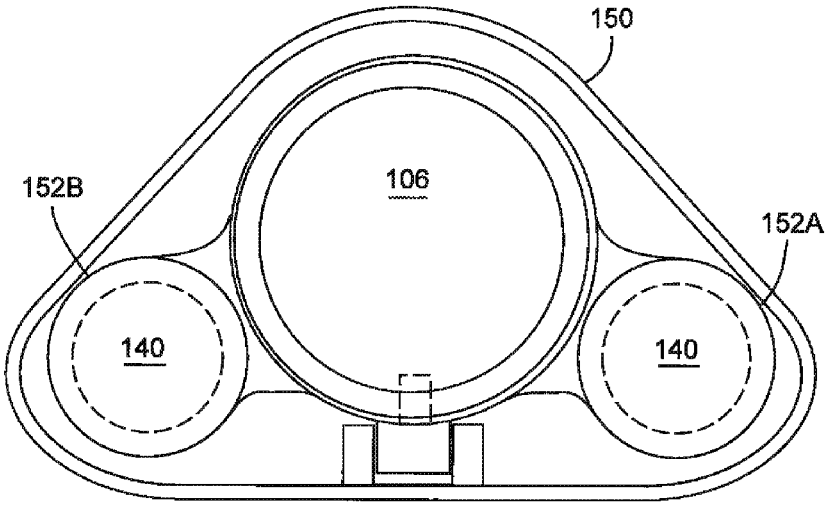
FIG. 7 is a cross-section of the buttstock and buffer tube of the weapon as shown in FIG. 1.
Figure 9:
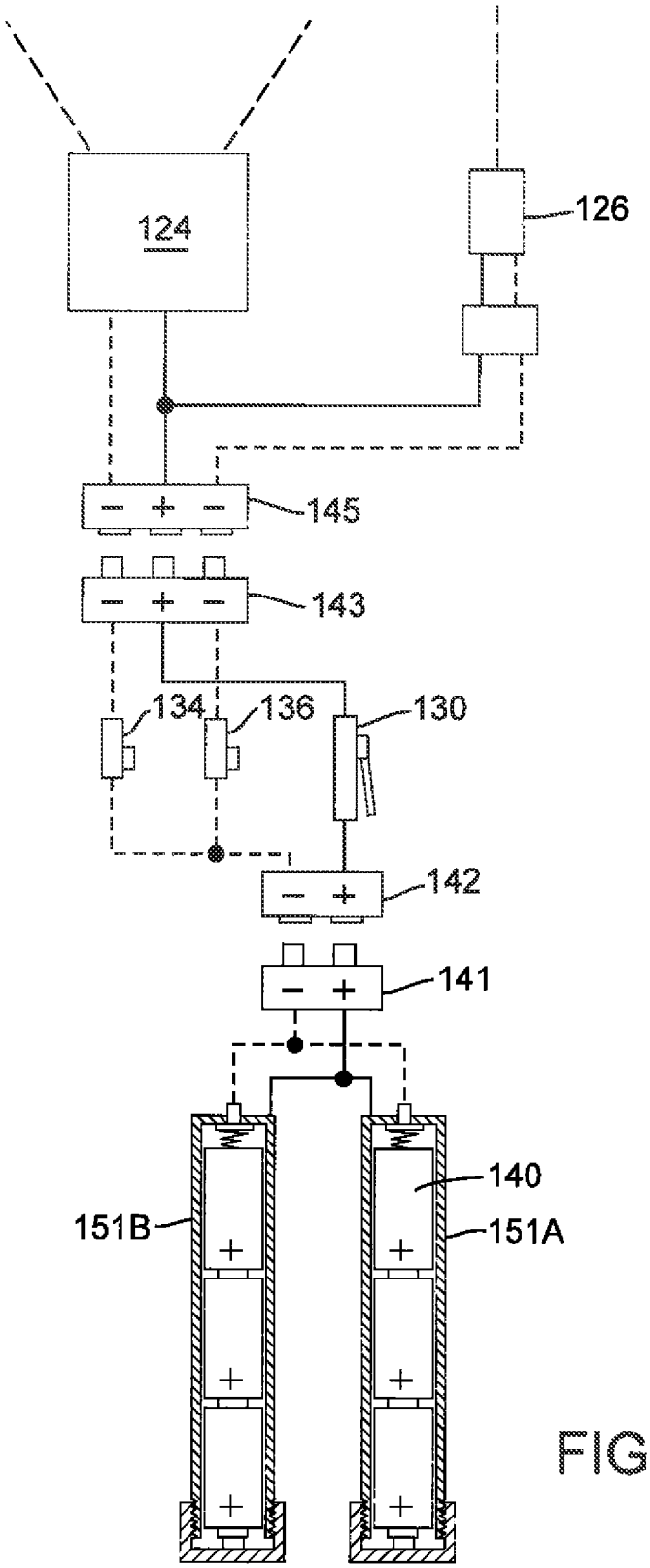
FIG. 9 is a wiring diagram of an embodiment of the device.

Power from the device 100 is supplied by batteries 140 that are contained within battery carriers 150A and 150B that are placed within battery housings 152A and 152 B, which are disposed along the buffer tube 106 as shown in FIG. 7. The batteries 140 are electrically connected to the buffer tube connector 141. The buffer tube connector 141 interfaces with and electrically connects to the grip housing 142. The electrical connection between the grip housing 142 and buffer tube connector 141 is accomplished using a pogo style pin connector, as shown in FIG. 9.

Figure 10:
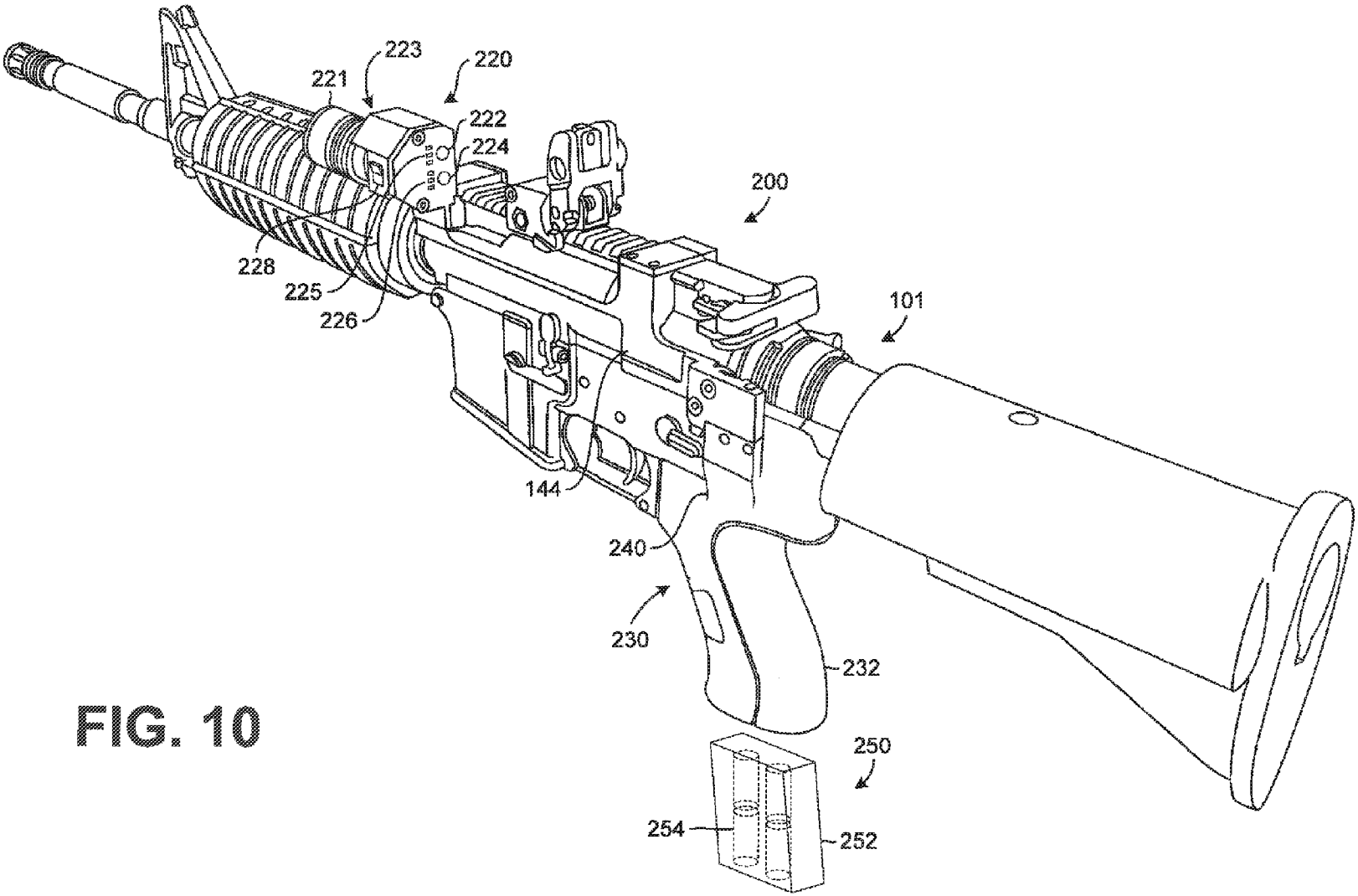
FIG. 10 is a perspective view of another embodiment of the laser aiming and illumination device mounted to a weapons platform.

Alternatively, the power source 254 may be contained within a modified grip 232 of the weapon 101, as shown in FIG. 10. The modified grip 232 can receive a power pack 252 or the power source 254 itself. A removable or hinged closure can be attached along the bottom of the modified grip 232 to seal the internal compartment from the external environment. In this embodiment, the buffer tube 106 is the standard buffer tube of the weapon 101 or can also be an aftermarket buffer tube installed by a user or others. Since the batteries are not stored along the buffer tube 106, the grip housing 142 is not required to feature the connection point that electrically connects to the buffer tube connector 141.

Further, in the alternative embodiment featuring the power source 254 disposed in the modified grip 232 of the weapon 101, additional power sources or battery(s) can be disposed along the buffer tube 106 as discussed in the previous embodiment. In this embodiment the power source 240 is housed in the modified grip 232 and includes additional power source(s) along the buffer tube 106, providing an increased power reserve. This increased power reserved can allow a user to operate the laser aiming and illumination device 100 for an extended period of time, extending the interval between battery replacement and/or recharging.

The grip housing 142 is integrated with the grip 132. The existing grip of the weapon 101 is replaced by the user or other with the grip 132 of the device 100. Alternatively, the grip 132 can be installed as part of the manufacturing process of the weapon 101. Due to the modular and standardized design, the grip housing 142 aligns with the buffer tube connector 141. Replacement of the standard grip with the grip 132 is a well-known procedure that can be performed by users or others to customize or alter the weapon 101.

The grip 132 includes the activation switch 130 and the operating mode selectors 134 and 136. The grip 132 is pre-wired with the switch 130, selectors 134 and 136, the connector 143 and housing 142. Alternatively, the housing 142, connector 143, activation switch 130, and operating mode selectors 134 and 136 can be retrofitted to an existing grip of the weapon 101.

The electrical connections from the housing 142 run through the switches and to the lower connector 143 as further detailed in FIG. 9. The lower connector 143 utilizes the same pogo pin type connector as the electrical connection between the buffer tube connector 141 and the grip housing 142.

The use of the pogo pin type connection between the lower connector 141 and the upper connector 143 allows the electrical connection to be broken and restored with the opening and closure, remating, of the lower 102 and upper 103. The design of the AR-15 platform ensures that through the repetitive opening and closing of the weapon, the alignment of the weapon and its components is maintained. The device 100 uses this design feature to ensure that alignment of the electrical connectors 143 and 145 is maintained when the weapon 101 is "broken open." When the weapon is reclosed, remated, the electrical connection of the device 100 is restored through the pogo pin connectors.

The upper connector 145 electrically connects to the lower connector 143 when the lower 102 and upper 103 of the weapon 101 are closed and locked together. Wiring runs from the upper connector 145 and under or through the connection module 144 (FIG. 8).

Figure 2:
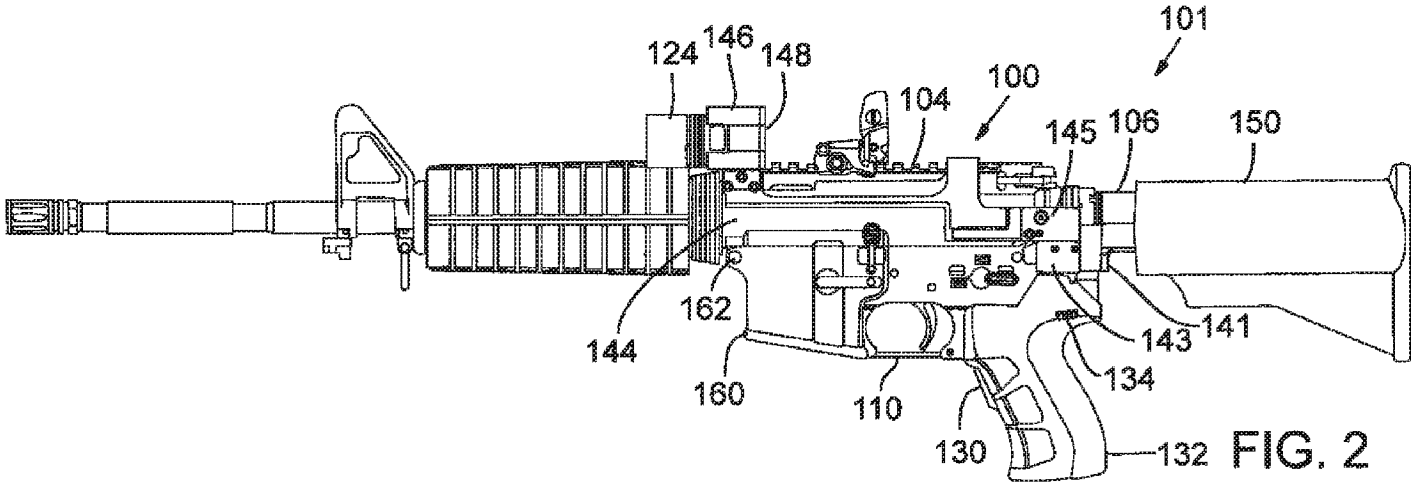
FIG. 2 is a left side view of the device mounted to the weapon as shown in FIG. 1.
Figure 6:
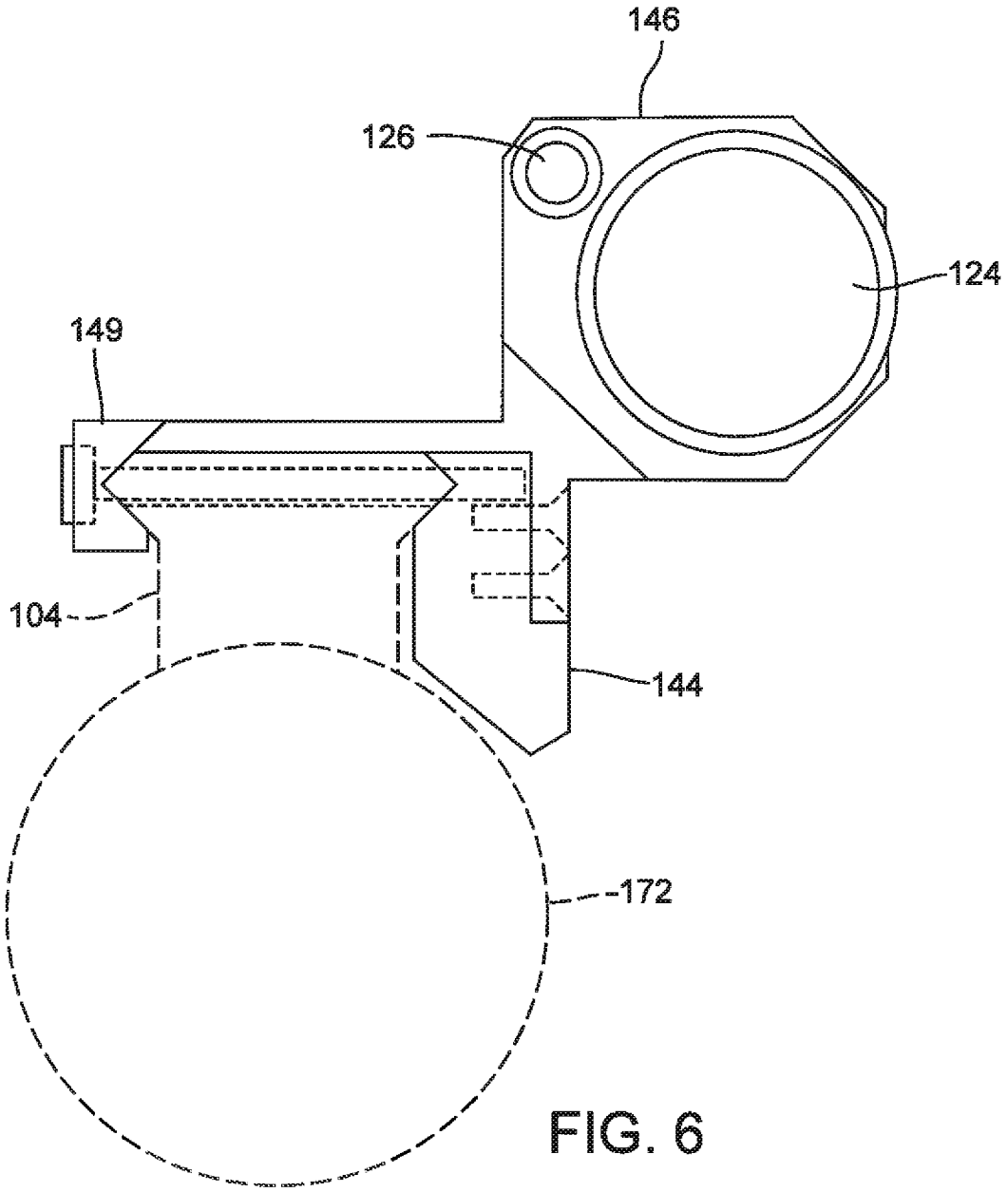
FIG. 6 is a front plan view of the device mounted on the weapon as shown in FIG. 1. The figure shows the front of the device mounted to an accessory rail of the weapon.
Figure 8:
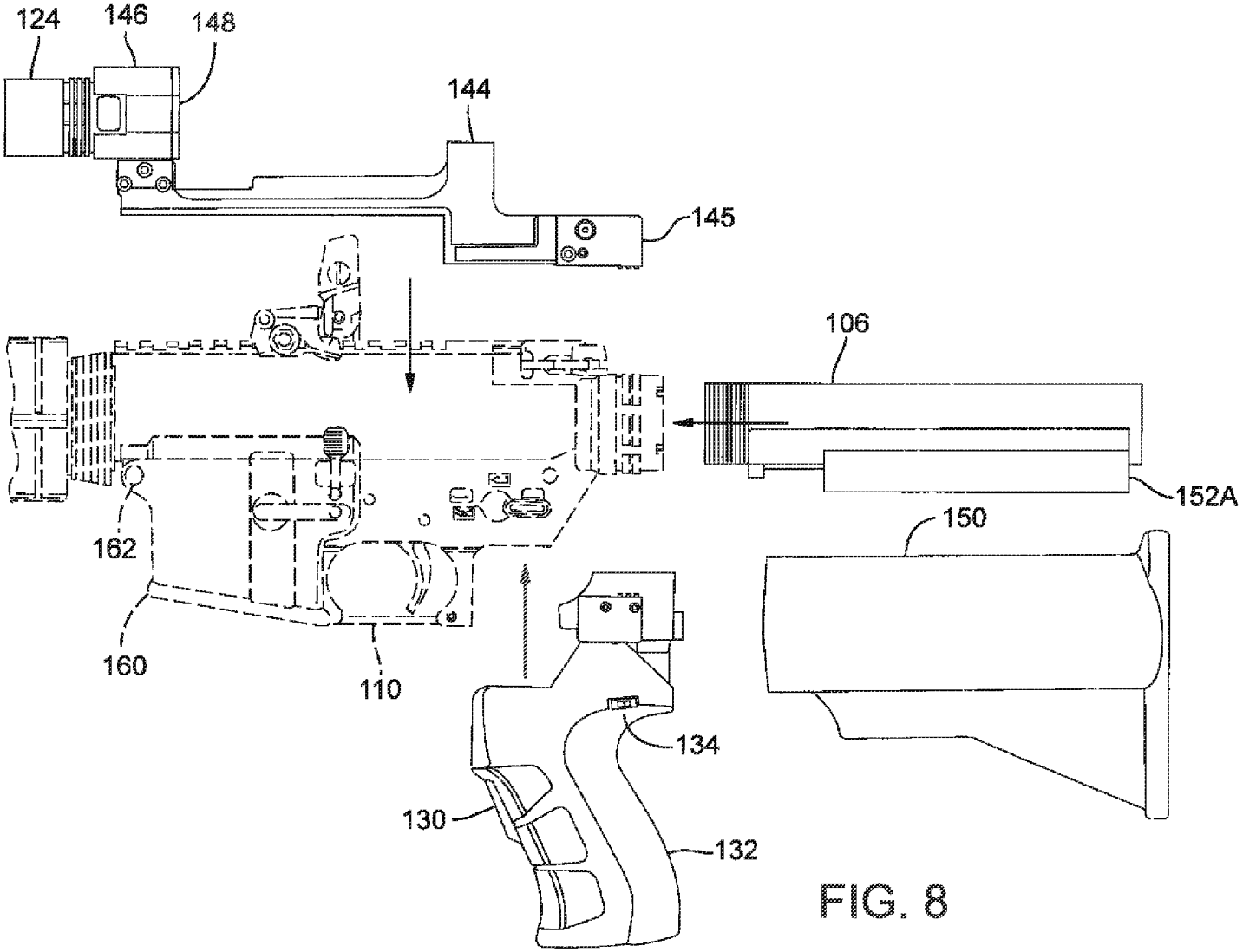
FIG. 8 shows the various device components and their mounting locations about the dashed line weapon as shown in FIG. 1.

The connection module 144 is attached to the weapon 101 using the accessory rail 104 as shown in FIGS. 1 and 8. A first retention element 147 clamps the rear of the connection module 144 of the device 100 to the rail 104. A second retention element 149 clamps the front of the connection module 144 of the device 100 to the rail 104, as shown in FIG. 6. The connection module 144 is mounted parallel and along the side of the weapon 101 as shown in FIG. 2. In this position, the connection module 144 does not interfere with the function of the weapon 101 and remains unobtrusive to the user during use of the weapon 101. The connection module 144 protects the wiring from the external environment and provides a rigid mounting point for the illumination module 146.

In placing the retention elements 147 and 149 spaced apart on the accessory rail 104, the middle portion of the accessory rail 104 is left open so that other accessories can be mounted as desired.

To avoid obstructing the function of the weapon 101, the device 100 is mounted on the side opposite the weapon's 101 ejection port. The device 100 can come in alternative embodiments depending on which side of the weapon the ejection port is located.

The illumination module 146 is connected to the front of the connection module 144 (see FIG. 8). In the embodiment shown, the illumination module 146 is connected to the connection module 144 using screws as shown in FIG. 6. Alternatively, the connection module and illumination module can be integrated into a singular module. The singular module may be machined or cast out of a suitable material.

The illumination module 146 can be connected to the connection module 144 using a pogo pin connection. This allows the electrical connection between the two modules 144 and 146 to be releasable. The releasable nature of the electrical connection allows the user to easily and readily switch or replace the illumination module 144 of the device 100. Other illumination modules 144 can include other illumination and/or laser sources a user may wish to include on their device 100 depending on the operating conditions the operator expects to face. For example, a current illumination module 144 can contain a visible illumination source and visible laser source. To maintain a level of stealth, the user can switch the current illumination module 144 for an alternative illumination module that contains an infrared illumination source and an infrared laser source.

The illumination module 146 houses the laser emitter 126 and illumination source 124. The wires from the upper connector 145 run under or through the connection module 144 and terminate in the illumination module 146.

An illumination module access 148 is disposed across the rear of the illumination module 146 and is retained by screws. The removable access 148 allows a user to access the wiring of the illumination source 124 and laser source 126. Additionally, the access 148 allows the user to change and/or maintain the illumination source 124 and laser source 126 if necessary or desired. The access 148 is affixed to the module 146 such that the intrusion of external environment is minimized or prevented.

The illumination source 124 can be a lamp or light that is disposed in housing 146 as shown in FIGS. 1 and 6. In the embodiment shown, the illumination source 124 is a high intensity light emitting diode (LED) that emits an intense, bright, white light. The light can be bright enough to disorient or temporarily blind a target looking into it. By disorienting or blinding the target with the light, a user can try to prevent or halt an assault to life or property without resorting to discharging the firearm. The LED can have a high output of 350 lumens or greater in some examples. The LED can also be capable of a lower, power conserving output that can be used to illuminate an area similar to a flashlight.

The directionality or the aim point of the illumination source 124 can be adjusted by the user or other. A system of shims, set screws and/or other suitable methods can be used to adjust the directionality of the illumination source 124. The adjustability of the directionality of the light allows the user or others to set the desired targeting point for the emitted light. The targeted point for the illumination source 124 can be the same or different from the point the laser emitter 126 is aimed toward.

The illumination source 124 can have multiple operating modes, such as steady-on low, steady-on high and strobe. The selection of the mode can be controlled by the illumination operating mode selector 134 on the grip 132, which controls the activation of the illumination source 124. Alternatively, the method of selecting the operating mode of the illumination source 124 may be positioned on the illumination source 124 itself or on the module 146. An example of such a method is a selection switch mounted to the illumination source 124 that allows the user to select the operating mode of the illumination source 124. Alternatively, a push button type selector switch can be disposed on the housing 146 and electrically connected to the illumination source 124. Actuation of the push button switch selects or cycles through the operating modes of the illumination source 124.

The illumination source 124 can also contain, or be, an infrared (IR) illumination source to illuminate the target and/or user surroundings. Light in the IR spectrum cannot be seen by the human eye; however, certain optical devices can detect the IR light and convert the light into a spectrum that is visible by humans. An example device that allows humans to see light in the IR spectrum is night vision goggles. It may be desirable to use IR illumination in situations in which a user does not wish to give away their position by using a visible light. Such situations include ones in which the assailant(s) are armed and actively seek to harm the user. The use of the IR illumination source and optical device allows a user to observe the scene and engage assailants as necessary. The IR illumination source can be located within the illumination source 124 with the high intensity LED or the illumination source 124 can contain either the IR illumination source or other illumination source. The illumination source 124 can be a detachable module from the device 100, as described above, so that the user can switch between an IR module and high intensity LED module as desired. Alternatively, as shown in the embodiment of FIG. 1, the illumination source 124 may be changed by a user or others by accessing the illumination source 124 through the illumination module access 148.

Additional operating modes may also be featured in the illumination source 124, such as an infrared or alternative light wavelength operating mode(s). The illumination source 124 may feature multiple illumination sources that may be activated, individually or in concert, as selected by a user.

Alternatively, the illumination source 124 can be an alternative light source such as a high intensity discharge (HID) illumination source, halogen illumination source, or other suitable light source.

The laser source 126 is mounted in the illumination module 146 of the device 100, as shown in FIG. 6. The laser source 126 can include a laser generator. A multitude of colors for the laser are available, including red, green, blue and others. A user, manufacturer or technician can properly align the laser source 126 with the bullet trajectory for accurate shooting. The laser source 126 can be adjusted by the user or others to move or align the aiming point or directionality of the laser source 126.

The laser source 126 of the device 100 can be initially "sighted" or aligned at the factory. The factory can also further refine alignment of the laser source 126 dependent on the model of weapon the device 100 is to be used with. The laser can be adjusted in the horizontal and/or vertical orientation using shims, set screws or other suitable means. If using a laser module, the laser can be aligned in the module and then mounted to the device and fine-tuned as necessary. External set screws may also be used to adjust the orientation of the laser within the housing, either integral or modular. This adjustment means would allow the manufacture to pre-sight the laser at the factory and allow a user to adjust the aim point or directionality as desired. When done properly at the manufacturer, the user should not need to readjust the laser aiming and thus it does not matter if the laser module is permanently affixed to the housing.

It is desirable to have the laser in the visible light spectrum so as to be seen by a target. The sight of a laser aiming dot can act as a deterrent to the target and prevent them from proceeding further. Alternatively, the laser can also be in the IR spectrum so as to be invisible to the human eye unless using an optical aid. As mentioned before, this can be desirable when the user does not want to reveal their location to the target. A user can switch the laser source 126 from a visible laser to an IR laser or vice versa as desired. The laser operating mode is controlled by the selector 134 which can be located near the trigger 110 or along a side of the grip 132 (FIG. 5B). The selector 134 can be a multi-position switch capable of selecting a mode, on, off or strobe, as desired by the user. As with the illumination source, the switch 134 can include any combination of the desired laser actions.

An activation switch 130 is located on the grip 132 of the weapon 101. When the weapon is held in the natural shooting or ready position, the user's shooting hand rests on the grip 132. Such positioning allows the user to easily actuate the activation switch 130 when handling the weapon 101. The closure of switch 130, on the front of the grip, completes the circuits for the illumination source 124 and the laser source 126, activating them in a selected operating mode, see FIG. 9.

Figure 3:
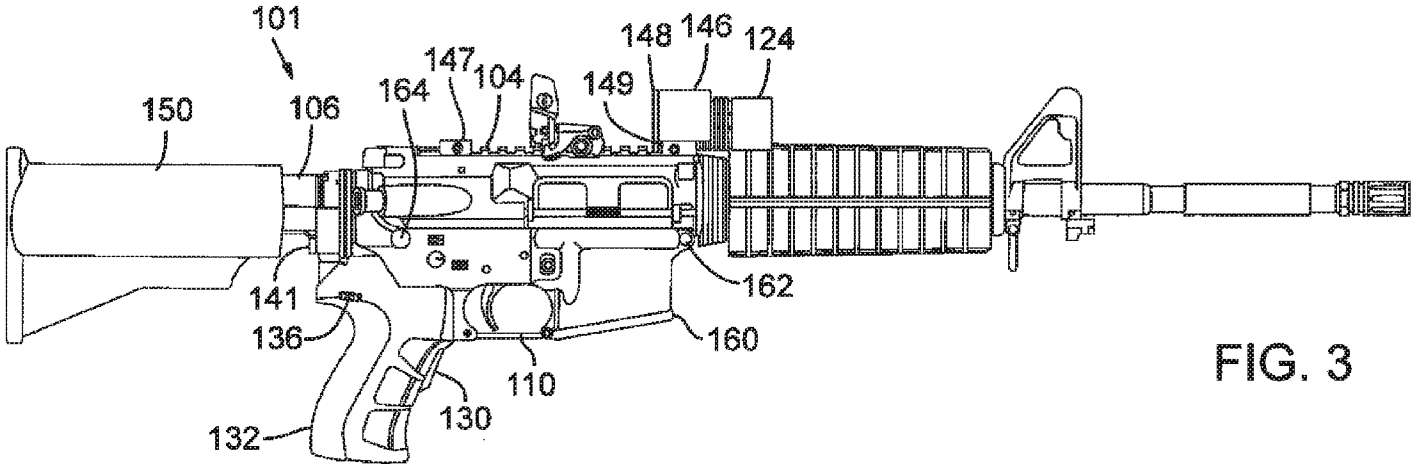
FIG. 3 is a right side view of the device mounted to the weapon as shown in FIG. 1.

Second and third switches, operating mode selectors 134 and 136, are located near the trigger 110 as shown in FIGS. 1-3. The illumination operating mode selector 134 controls the operating of the illumination source 124 and the laser operating mode selector 136 controls the operating mode of the laser source 126, seen in FIG. 9. In the embodiment of FIG. 1, the operating mode selectors 134 and 136 are multi-position switches. A user places an operating mode selector 134 or 136, in an "on" state to activate the circuit to the attached illumination/laser source. Upon actuation of activation switch 130, the circuit is completed and any illumination element in an "on" state, as selected by operating mode selectors 134 and/or 136, is activated. The selection of the device laser 126 and/or illumination source 124 may be done by a user prior to readying the weapon or may be activated by the user while holding the weapon in a ready position.

FIG. 7 is a cross-section illustrating the batteries 140 mounted in battery carriers 151A and 151B, disposed within battery housing 152A and 152B, which are integrated with the buffer tube 106. Alternatively, the housings 152A and 152B can be removable from the buffer tube 106. The housings 152A and 152B contain the removable battery carriers 151A and 151B containing the batteries 140 that power the device 100. Alternatively, other power supplies may be utilized and mounted about the buffer tube 106 accordingly. Additionally, the positioning of the battery housings 152A and 152B about the buffer tube 106 can be modified as desired by a user or others.

The batteries 140 are connected in series within each carrier 151A and 151B as shown in FIG. 9. The batteries 140 are replaceable and are accessible through screw caps that seal the housings 152A and 152B. Alternative battery housing designs and battery layouts can be used. Additionally, the batteries and housing may be integrated into self-contained power units that are replaceable within the device 100. The housings 152A and 152B are electrically connected in parallel to the buffer tube connector 141.

A buttstock 150 slides over the buffer tube 106 and battery housing 152A and 152B as shown in FIG. 9. The buttstock 150 protects the batteries 140, housings 152A and 152B and the wiring from the external environment. The flared sides of the buttstock 150 provide a cheek rest for the user when the weapon 101 is brought up to a shouldered position. The buttstock 150 is adjustable and can slide back and forth along the buffer tube 106 to adjust the overall length of the weapon 101.

It will be understood that the positioning of the battery housing(s) 152A and/or 152B can be multiple locations about the buffer tube 106. Additionally, the cross-section of the buttstock 150 can varied to accommodate the position of the battery housing(s) 152A and/or 152B.

FIG. 8 illustrates the components of the device: the buffer tube 106, buttstock 150, grip 132, activation switch 130, operating mode selectors 134 and 136 (FIG. 3), buffer tube connector 141, grip housing 142, lower connector 143, upper connector 145, connection module 144, illumination module access 148, illumination module 146, and illumination source 124. Arrows are shown to indicate the mounting of the components about the weapon 101 as dashed lines.

FIG. 9 shows the wiring layout for the device 100. The batteries 140 are contained within the carriers 151A and 151B and are electrically connected to the buffer tube connector 141. The pin type connection of the buffer tube connector 141 electrically connects to the grip housing 142. The grip housing connects to the activation switch 130 and operating mode selectors 134 and 136. The switch and selectors are electrically connected to the lower connector 143 which is also a pin type connection. The upper connector 145 is another pin type connector and electrically connects to the illumination source 124 and laser source 126. As shown in the wiring diagram, the positive path of the illumination source and laser source circuits are controlled by the activation switch 130. Both the illumination source and laser source circuits have separate negative paths. The negative paths each include an operating mode selector 134 or 136 that controls the operating mode of the individual circuit element, the illumination source 124 or laser source 126.

FIG. 10 illustrates an example embodiment of the laser aiming and illumination device 200 mounted to a weapons platform 101. In the embodiment shown, the device 200 includes an illumination module 220, illumination mode selectors 222 and 224, a connection module 144, an activation switch 230 and a power module 250. The power module 250 is contained within a modified grip 232 of the weapons platform 101. A grip connector 240 electrically connects the power module 250 with the connection module 144 which is electrically connected to the illumination module 200.

The illumination module 220 includes at least an illumination source 221 and/or a laser source 223. Multiple illumination and/or laser sources 221 and 223 can be included within the illumination module 220. The use of multiple sources 221 and 223 allows the user to have multiple illumination and/or laser types and sources for use depending on a use situation. Such illumination and laser types and sources can include an infrared source, a visible source, an ultraviolet source, and other tuned or broad spectrum sources.

The illumination module 220 can include an access into the interior of the module 220. The access can be permanently or temporarily fastened to the housing using an adhesive or a temporary fastener such as a screw. In the embodiment shown, the illumination housing access is fastened to the illumination module 220 using a temporary fastener, thereby allowing a user or other to access the interior of the module 220 as necessary. Access to the interior of the module 220 allows the user or other to repair, upgrade, and/or swap the components, including the illumination source 221 and laser source 223.

A seal or gasket can be disposed about the periphery of the illumination module access. The seal or gasket interfaces with the illumination module 220 to seal or environmentally isolate the interior of the module. By environmentally isolating the interior of the illumination module 220, the electronic components within the module are protected from moisture, dirt, and other environmental intrusion. The seal or gasket can be a molded rubber or silicon gasket or seal, a rubber or silicon O-ring, or other suitable sealing element. Alternatively, a silicon caulk or other moldable or depositable sealing material can be deposited or molded about the periphery of the illumination module access to provide the seal.

The illumination module 220 of the device 200, as shown in FIG. 10, includes an illumination source operating mode selector 222 and a laser source operating mode selector 224. A control board and/or control circuitry is included within the illumination module 220 allowing a user to select an operating mode of the illumination source and/or the laser source by actuating the operating mode selectors, 222 and 224. The selectors 222 and 224 are push button switches that can be easily actuated by a user while wearing operational equipment, such as gloves. Other selectors can be used, such as the multi-position switches as detailed in the previously described embodiment. Actuating the selectors 222 and 224 cycles through the various available illumination and laser source operating modes.

In the embodiment shown, a control board is disposed within the illumination module 220 and controls the operating mode of the illumination source 221 and laser source 223. Using mode selectors 222 and 224, the user can select the operating mode for each of the illumination source and laser source. The illumination source and laser source are activated in the selected operating modes when the activation switch 230 is actuated by a user.

The selected operating mode of the illumination source 221 and laser source 223 can be indicated to the user by an illumination operating mode indicator 225 and the laser operating mode indicator 226. In the embodiment shown, the indicators 225 and 226 are disposed within apertures on the back of the illumination module 220. The control board can include LEDs that can be seen through the indicator apertures to indicate a selected operating mode. Each of the LEDs indicates a different operating mode of the illumination and laser sources. In the example shown the illumination mode indicator 225 corresponds to the operating mode of the illumination source 221 and the laser mode indicator 226 corresponds to the operating mode of the laser source 225. Selectable operating modes can include steady off, steady on, intermittent on, and other desirable operating modes.

The control board LEDs used to indicate the selected operating modes of the illumination and laser sources can be momentarily "on" or steady "on" to indicate the selected operating mode. In the momentary "on" embodiment, a control board LED flashes to indicate the selected operating mode. In the steady "on" mode embodiment, the control board LED would stay lit to indicate the selected operating mode. Additionally, the brightness of the control board LEDs can be adjusted or pre-selected to minimize the signature of the lit LEDs, either momentarily or steady "on." Reducing the brightness of the control board LEDs reduces the chances of others observing the illumination of the control board LEDs.

The control board LEDs are recessed in apertures, thereby shielding and directing the light emitted by the control board LEDs. In doing so, the indicators 225 and 226 are shielded from view of others while still being visible to a user. Shielding the indicators 225 and 226 is important for maintaining a user's stealth while operating the weapon 101.

In the embodiment of FIG. 10 the user actuates the selector 222 to cycle through the operating modes of the illumination source 221. The currently selected operating mode is indicated by the illumination mode indicator 225. The user repeatedly actuates the selector 222 until the desired operating mode is selected, as indicated by the illumination mode indicator 225. When the device 200 activation switch 230 is actuated by a user, the illumination source is activated in the selected operating mode. The same process is repeated to select the operating mode of the laser source 223.

Alternatively, a single selector can be used to control both the illumination and laser sources. The single selector can be configured to select the same or different operating modes for both the illumination and laser sources. That is, the selector can select to operate both sources in the same mode, such as "steady on" or can progress through various operating modes for each, such as "illumination steady on, laser steady off." The indicated operating mode(s) controlling one or both the illumination and/or laser source can be indicated by the control board LEDs through the indicator apertures.

In other example devices, multiple illumination sources and/or laser sources can be included within the illumination housing. To control the various illumination and laser sources, multiple operating mode selectors can be included on the illumination module 220. Multiple corresponding indicators, corresponding to the multiple illumination and laser sources, can be included on the module 220.

Alternatively, a single selector can be used to control the multiple illumination and/or laser sources. As described above, the single selector can select a singular operating mode for all of the sources, select a pre-programmed operating mode for the multiple sources, or select different modes for each of the sources.

The function and number of operating modes selectable by an operating mode selector can be programmed into the control board and/or control circuitry by a manufacturer. Alternatively, the operating modes can be adjusted or customized by a user. The user can access and modify the settings of the control board and/or circuitry. The modification of the control board settings, such as the illumination and laser sources operating modes, can be done by the user through a computer interface, such as a mobile application or computer program, or other suitable modifying methods. The modification of the control board settings can be done by physically connecting the control board to a computer interface or connecting to the control board using a wireless communication protocol such as Bluetooth®.

Figure 11:
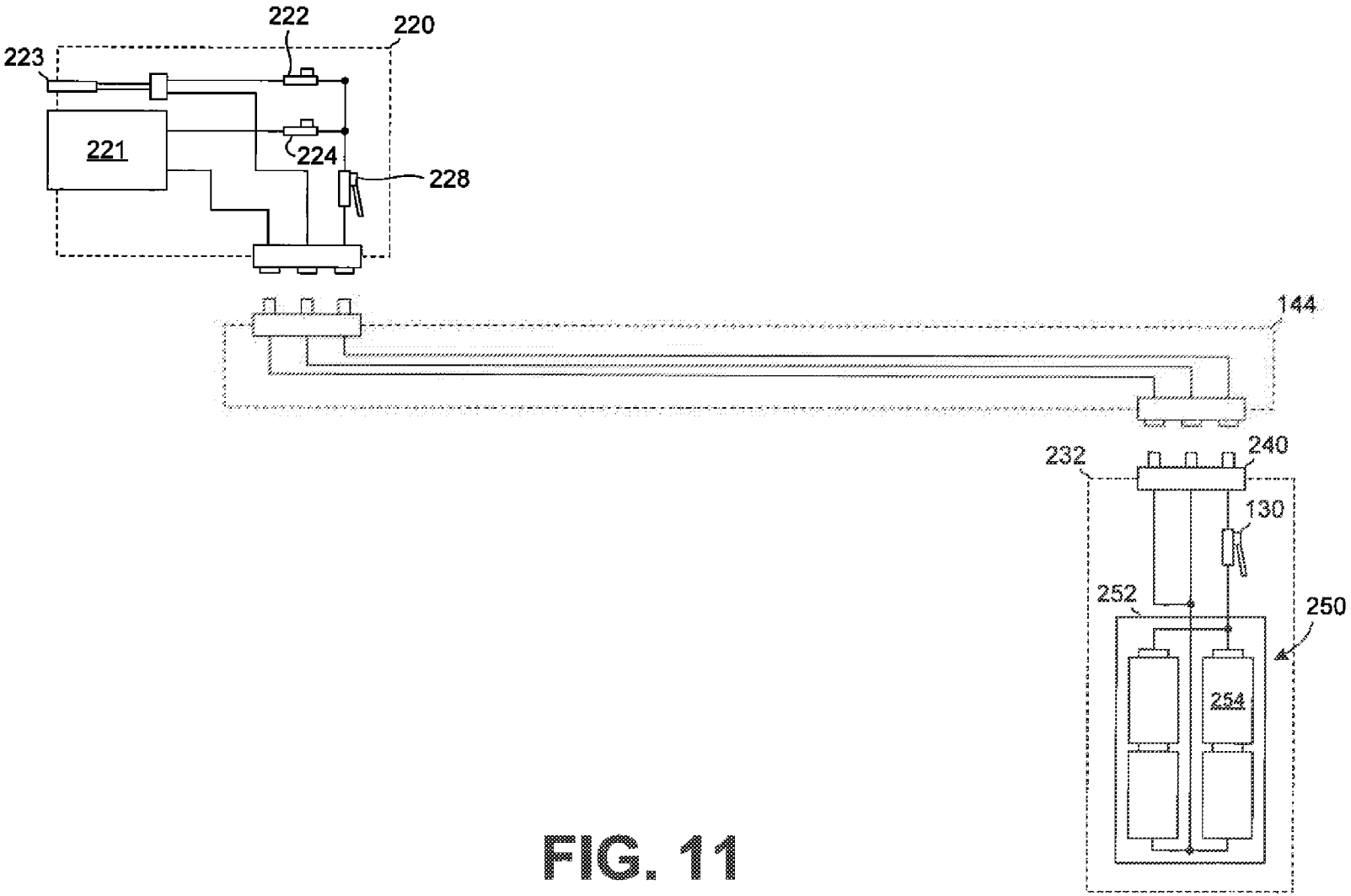
FIG. 11 is a wiring diagram of another embodiment of the device.

The illumination module 220 can include a main switch 228, as shown in FIGS. 10 and 11. The main switch 228 can be actuated by a user to completely disable the device 200, preventing the illumination source or laser source from being activated upon actuation of the activation switch 230. Using the main switch 228 to completely disable the device 200 prevents inadvertent activation of any illumination elements which can sap power from the power source 254, decreasing the power reserve remaining for operation of the device 200. Further, disabling the device 200 using the main switch 228 can prevent inadvertent activation of the device 200 during operations during which an operator or user's stealth is important to operation success.

In the example embodiment shown, the main switch 228 is a toggle-style switch having an "off" and an "on" position. Alternative switches and switch styles can be used depending on user or design requirement. Alternate switches can include push-button switches or switches having a protected feature that prevents inadvertent actuation of the switch. In a further embodiment, the main switch can include an automatic shut-off feature. This feature can be triggered by a signal from the control board within the illumination module 220.

As described above, the illumination module 220 can be releasably electrically connected to the connection module 144 of the device 200. In the embodiment shown in FIG. 11, the illumination module 220 is electrically connected to the connection module 144 via a pogo pin connection. The releasable nature of this electrical connection allows various illumination modules 220 to be switched or replaced on the device 200. This allows a user to quickly and easily change the illumination and/or laser sources of the device 200. For example, the user can swap the existing illumination module 220 for another module containing a different illumination and/or laser source, depending on the situation in which the user can expect to operate the device 200 and weapon 101.

In the embodiment shown in FIG. 10, the laser aiming and illumination device 200 includes a power module 250 that is insertable into a modified grip 232 of the weapons platform 101. The power module 250 includes a power pack 252 that contains a power source 254. The power pack 252 includes contacts, or circuitry, that electrically connect the power module 250 to the grip connector 240 that is integrated into the modified grip 232.

The grip connector 240 is releasably electrically connected to the connection module 144 by a pogo pin connection. This connection allows the weapons platform 101 to be "broken open" as normal, without requiring removal or modification of the weapon 101 or the device 200. Once the weapon 101 is closed and the lower portion 102 and upper portion 103 are remated, the electrical connection between the grip connector 240 and the connection module 144 is restored through the pogo pin connection.

The modified grip 232 is a multi-piece grip structure that can be installed or retrofitted onto the weapons platform 101 by a user or other. The modified grip 232 includes the grip connector 240 and internal circuit elements that connect the removable power pack 252 to the grip connector 240. A release mechanism is also included, allowing the user to quickly release, remove, and replace the power pack 252.

The power pack 252 contains the power source 254 which are preferably lithium batteries as shown in the embodiment of FIG. 10. The example power pack 252 includes circuitry and/or contacts that connects multiple batteries 254 into subgroups. The batteries of the subgroups are connected in series and the subgroups are connected in parallel. This configuration allows the batteries to be connected in a manner to achieve the desired, or required, voltage and/or current levels to power the device 200.

In alternative embodiments, the power source 254 can be rechargeable batteries or the power pack 252 itself can be a rechargeable or disposable battery that is the power source 254. The power pack 252 can be quickly swapped or changed once the power source 254 is depleted or exhausted.

Further, the power module 250 can include a power reserve indicator indicating the power reserve remaining in the power source 254. The power reserve information is communicated to a user or others to indicate the remaining power of the device 200, allowing the power source 254 to be exchanged for one having a greater remaining power reserve. A power reserve indicator can be a simple light system indicating green for predetermined power reserve level, indicating yellow or red when the remaining power reserve is below a threshold level. Alternatively, an actual power reserve amount, expressed as a percentage or other value, can be communicated to a user or other by the power module 250 directly or indirectly by an external power reserve determination device or method.

A camera can also be included in the illumination module, or as a separate module, to record or transmit the sight picture of the weapon 101, the view as seen down the length of the weapon 101. The captured video can be recorded to a memory module that is stored on or external to the laser aiming and illumination device 100. Alternatively, the footage can be transmitted wirelessly to a remote recorder or transmitted for live viewing. The user or others can watch the live or recorded footage to review, respond, and critique the situational response. It will be understood that the recording capability and/or module can be included on any embodiment of the laser aiming and illumination device.

Figure 12:
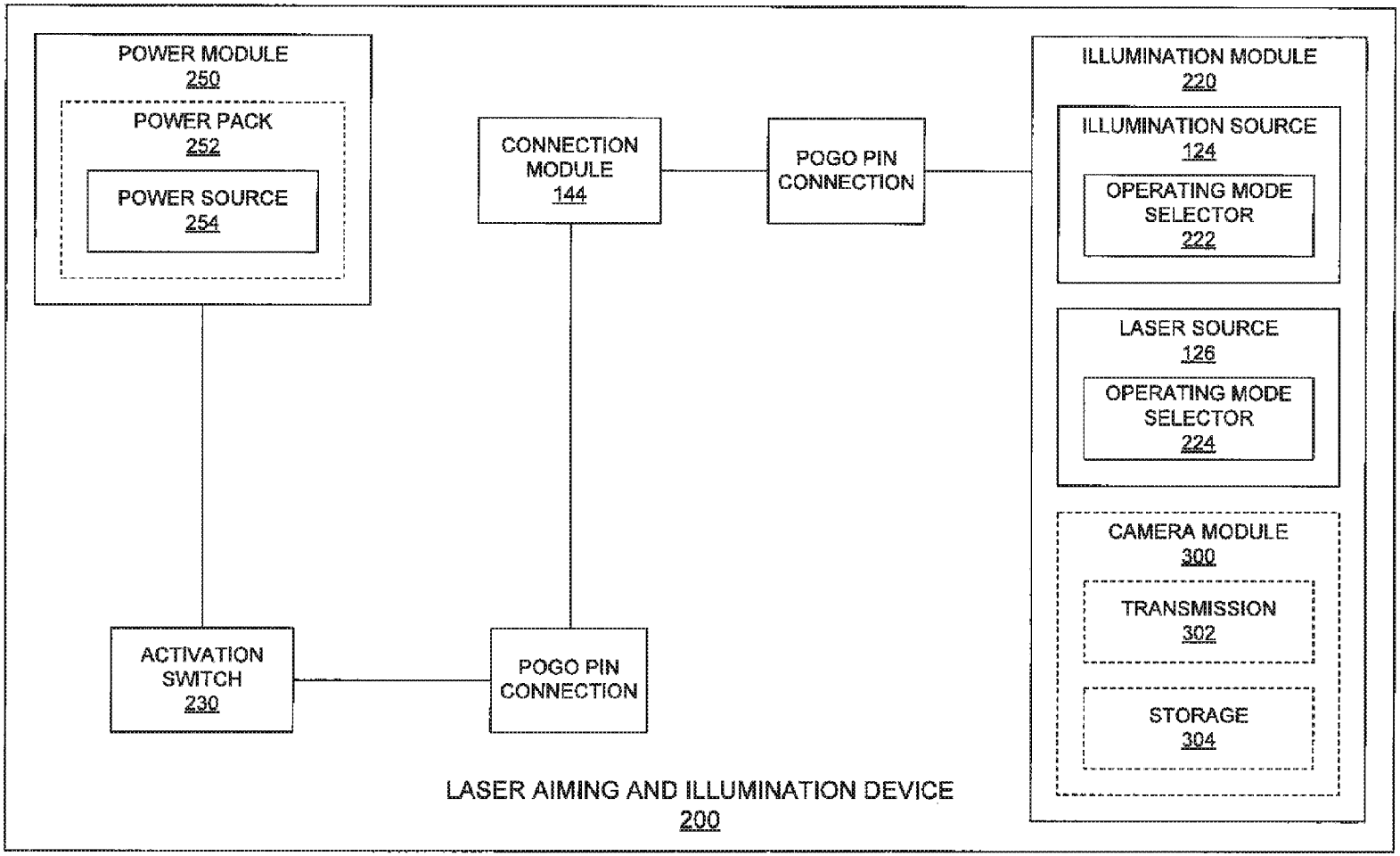
FIG. 12 is a block diagram of a further embodiment of the laser aiming and illumination device including a camera.

FIG. 12 shows an example embodiment of the device 200 including the optional camera module 300. The camera module 300, as shown, is disposed within the illumination module 220 with the requisite power supply coming from the power module 250 through the connection module 144. Included within the camera module 300 is the optional transmission 302 and storage circuitry 304. The transmission circuitry 302 can transmit recorded or live images from the camera module 300 remotely from the device 200 or to another portion of the device 200, such as a storage module. Alternatively, storage of recorded images from the camera module 300 can be done by storage circuitry, or module, 304 that is contained within the camera module 300

The recording/transmission of the sight picture can be activated when the laser aiming and illumination device 100 is activated by the activation switch 130. Alternatively, the camera can be activated by the user, a remote observer, or other protocol such as time or location based activation. Activation of the camera allows the recording and/or transmission of the sight picture of the device and weapon for later or live review.

Alternatively, the camera can be mounted in a separate camera module that can be disposed elsewhere on the weapon 101 or device 100. The camera module can include recording storage and/or transmission circuitry to record and/or transmit the captured imagery. A storage module can be included on the device 100, the weapon 101 or mounted to or carried by the user. Captured image data can be transmitted from the camera to the storage module where the data is recorded. The data can be transmitted through a wired or wireless connection, allowing the storage module to be placed remotely from the camera module. Transmission circuitry for the camera and storage module can be disposed in other and/or differing components/modules of the device 100, allowing for a more efficient distribution of components. One such application could be the integration of an antenna structure with the connection module 144 and/or illumination module 146, allowing the antenna structure to have an increased surface area for transmission and/or reception.

The camera and recording modules can be powered by the device power module or powered by alternative or additional power modules connected to one or more of the camera and recording modules.

The device, as discussed above, may be installed on new or existing weapons by a manufacturer, a technician, or a user. The devices may be installed on weapon during the manufacture process or retrofitted to existing weapons.

The initial targeting or sighting-in of the laser and/or lighting unit is accomplished by device manufacturer. Once installed, the aiming of the illumination sources may be fine-tuned or adjusted by the user or installer using included adjustment means, such as shims or set screws.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be used for realizing the invention in diverse forms thereof.

The invention claimed is:

1. A laser aiming and illumination device configured to be mounted onto a weapon such that mounting the device onto the weapon does not require permanent alteration of the weapon, the weapon having a trigger and an accessory rail, the laser aiming and illumination device, comprising:

an illumination module, including at least one of an illumination source and a laser source mounted to the accessory rail;

an illumination mode selector configured to select an operating mode of the at least one of the illumination source and the laser source;

a power module including a power source;

an activation switch disposed adjacent the trigger of the weapon and configured to operate the at least one of the illumination source and the laser source in the selected operating mode; and a connection module configured to releasably electrically connect the power module and the illumination module, wherein the connection module protects wiring between the connection module and the power module from the external environment and the wiring runs inside the modules, the connection module connected to the accessory rail by front and back retention elements.

2. The laser aiming and illumination device of claim 1 wherein the illumination module is releasably electrically connected to the connection module.

3. The laser aiming and illumination device of claim 1 wherein the connection module includes a pogo pin connection that electrically connects the power module and illumination module in a releasable manner.

4. The laser aiming and illumination device of claim 1 wherein the connection module includes a pogo pin connection that releasably electrically connects the connection module to the power module.

5. The laser aiming and illumination device of claim 1 wherein the illumination source is selected from one of an incandescent lamp, a halogen lamp, a light emitting diode.

6. The laser aiming and illumination device of claim 1 wherein the illumination source emits infrared light.

7. The laser aiming and illumination device of claim 1 wherein the illumination module includes multiple illumination sources.

8. The laser aiming and illumination device of claim 1 wherein the laser source emits infrared light.

9. The laser aiming and illumination device of claim 1 wherein the illumination module includes multiple laser sources.

10. The laser aiming and illumination device of claim 1 wherein the illumination mode selector is configured to select one of a steady-on, steady-off, or intermittent-on operating mode for one of the selected illumination source or laser source.

11. The laser aiming and illumination device of claim 1 wherein the illumination mode selector indicates a selected operating mode, the indicator substantially visible to a user and substantially invisible to others.

12. The laser aiming and illumination device of claim 1 configured to be releasably mounted to a weapon.

13. The laser aiming and illumination device of claim 12 wherein the connection module is configured to break an electrical connection between the power module and the illumination module when a lower portion of the weapon is separated from an upper portion of the weapon and reestablish the electrical connection when the lower portion of the weapon is remated with the upper portion of the weapon through a connector.

14. The laser aiming and illumination device of claim 12 wherein the power module of the device is disposed within a handgrip of the weapon.

15. The laser aiming and illumination device of claim 12 wherein the power source includes a plurality of batteries disposed within a power pack.

16. The laser aiming and illumination device of claim 15 wherein the batteries are organized into subgroups, the power pack configured to electrically connect the batteries of a subgroup in series and electrically connect the subgroups in parallel.

17. The laser aiming and illumination device of claim 12 wherein the power module is disposed within a housing along a buffer tube of the weapon and is releasably electrically connected to the connection module.

18. The laser aiming and illumination device of claim 17 wherein the power source includes a plurality of batteries disposed within a power pack.

19. The laser aiming and illumination device of claim 17 wherein the batteries are organized into subgroups, the power pack configured to electrically connect the batteries of a subgroup in series and electrically connect the subgroups in parallel.

20. A weapon in combination with the laser aiming and illumination device of claim 1, the weapon including an upper receiver separably mated to a lower receiver, the lower receiver including a handgrip and a trigger assembly having a trigger, the power module mounted to the lower receiver, the illumination module mounted to the upper receiver, and the connection module arranged to electrically disconnect the power module and the illumination module when the upper and lower receivers are separated.

* * * * *